US011035573B2

(12) United States Patent
Schmid

(10) Patent No.: US 11,035,573 B2
(45) Date of Patent: Jun. 15, 2021

(54) APPARATUS AND METHOD FOR BUILDING A SUSTAINABLE FIRE

(71) Applicant: Benjamin D. Schmid, Medina, OH (US)

(72) Inventor: Benjamin D. Schmid, Medina, OH (US)

( * ) Notice: Subject to any disclaimer, the term of this patent is extended or adjusted under 35 U.S.C. 154(b) by 47 days.

(21) Appl. No.: 16/361,540

(22) Filed: Mar. 22, 2019

(65) Prior Publication Data

US 2020/0300473 A1 Sep. 24, 2020

(51) Int. Cl.
*F24B 1/195* (2006.01)
*F24B 15/00* (2006.01)

(52) U.S. Cl.
CPC ..... *F24B 1/195* (2013.01); *F24B 15/005* (2013.01)

(58) Field of Classification Search
CPC ..... F24B 206/821; Y10S 206/821
USPC ..... 126/152 R, 25 R, 29, 30, 540; 431/6
See application file for complete search history.

(56) References Cited

U.S. PATENT DOCUMENTS 1,954,601 A * 4/1934 Sowerwine ..... A47F 7/175 108/92
6,199,546 B1 3/2001 Freemon

FOREIGN PATENT DOCUMENTS

JP 2011075270 A 4/2011
WO 2003080770 A1 10/2003

OTHER PUBLICATIONS https://www.thegreenhead.com/2013/08/log-teepee-campfire-grate.php.*
https://www.strawbale.com/burn-an-upside-down-fire-for-efficiency.*

* cited by examiner

*Primary Examiner* — Vivek K Shirsat
(74) *Attorney, Agent, or Firm* — Wegman Hessler

(57) ABSTRACT

An apparatus for building a fire, the apparatus having a frame, the frame providing four substantially vertical members, and a plurality of transversely extending crossbars therebetween, wherein the frame is generally shaped as a pyramidal frustum. A method for building a sustainable fire, the method providing an apparatus; arranging a series of tiers on the apparatus; and igniting a fire.

14 Claims, 7 Drawing Sheets

APPARATUS AND METHOD FOR BUILDING A SUSTAINABLE FIRE

FIELD OF THE INVENTION

The disclosed technology relates generally to an apparatus and method for building a sustainable fire, and in particular, but not exclusively to, an apparatus and method for a unique stacking structure that can be used to build or assemble a sustainable fire.

BACKGROUND OF THE INVENTION

Fire building or fire starting, while often thought of as a luxury (such as for use during camping or social gatherings, etc.), can be essential to survival in certain situations. For instance, starting a fire provides warmth, light, a means for signaling in the wilderness, and a means for water purification and/or cooking.

However, in modern times, many people would not have the knowledge to build or even start a basic fire. And while experienced fire builders and/or avid outdoorsmen may have the skills and understanding to build a fire, even those most experienced outdoorsmen cannot prepare for extreme weather conditions, yet build a fire to sustain such extreme conditions.

Therefore, what is needed in the art is a way for a user (including a novice fire builder or outdoorsman) to construct a sustainable fire that can withstand extreme conditions.

SUMMARY OF THE INVENTION

The disclosed technology generally described hereinafter provides for an apparatus for building a fire. In one aspect of the disclosed technology, the apparatus comprises a frame, the frame providing four substantially vertical members, and a plurality of transversely extending crossbars therebetween, wherein the frame is generally shaped as a pyramidal frustum.

In some embodiments, the frame is a steel frame. In some embodiments, the vertical members are comprised of right-angle steel bars. In some embodiments, the vertical members are at least 10 inches in length. In some embodiments, the crossbars are comprised of right-angle steel bars. In some embodiments, the frame comprises at least eight crossbars. In some embodiments, the apparatus provides for at least four tiers or stacked levels.

In yet another aspect of the disclosed technology, a method for building a sustainable fire is disclosed. In some embodiments, the method comprises providing an apparatus; arranging a series of tiers on the apparatus; and igniting a fire.

In some embodiments, the apparatus comprises a frame. In some embodiments, the frame comprises four substantially vertical members, and a plurality of transversely extending crossbars therebetween. In some embodiments, the frame is generally shaped as a pyramidal frustum. In some embodiments, the step of arranging a series of tiers on the apparatus includes loading a plurality of firewood onto the series of tiers. In some embodiments, arranging the series of tiers comprises: (a) arranging a first tier; (b) arranging a second tier; (c) arranging a third tier; and (d) arranging a fourth tier.

In some embodiments, (i) the second tier comprises a plurality of firewood that is positioned transverse to a plurality of firewood positioned on the first tier; (ii) the third tier comprises a plurality of firewood that is positioned transverse to the second tier and parallel to the first tier; and (iii) the fourth tier comprises a plurality of firewood that is positioned transverse to the third tier and the first tiers, and parallel to the second tier. In some embodiments, the series of tiers do not physically touch.

In some embodiments, the step of igniting a fire comprises starting, lighting, or igniting the plurality of firewood that is located or positioned on the fourth tier. In some embodiments, the fourth tier is located at the upper-most portion of the apparatus. In some embodiments, the plurality of firewood that is located or positioned on the fourth tier is provided in an upside-down fire stacking arrangement.

In yet another aspect of the present technology, an apparatus for building a fire is provided. In some embodiments, the apparatus comprises a frame, wherein the frame is generally shaped as a square frustum, the frame having: (a) four substantially vertical members, each vertical member being at least 18 inches in length, wherein each vertical member is a right-angle steel bar; and (b) eight transversely extending crossbars, wherein each crossbar is a right-angle steel bar; wherein the frame provides for at least four tiers or stacked levels. In some embodiments, the frame is foldable or collapsible.

BRIEF DESCRIPTION OF SEVERAL VIEWS OF THE DRAWINGS

These and other features of the disclosed technology, and the advantages, are illustrated specifically in embodiments now to be described, by way of example, with reference to the accompanying diagrammatic drawings, in which.

Figure 1:
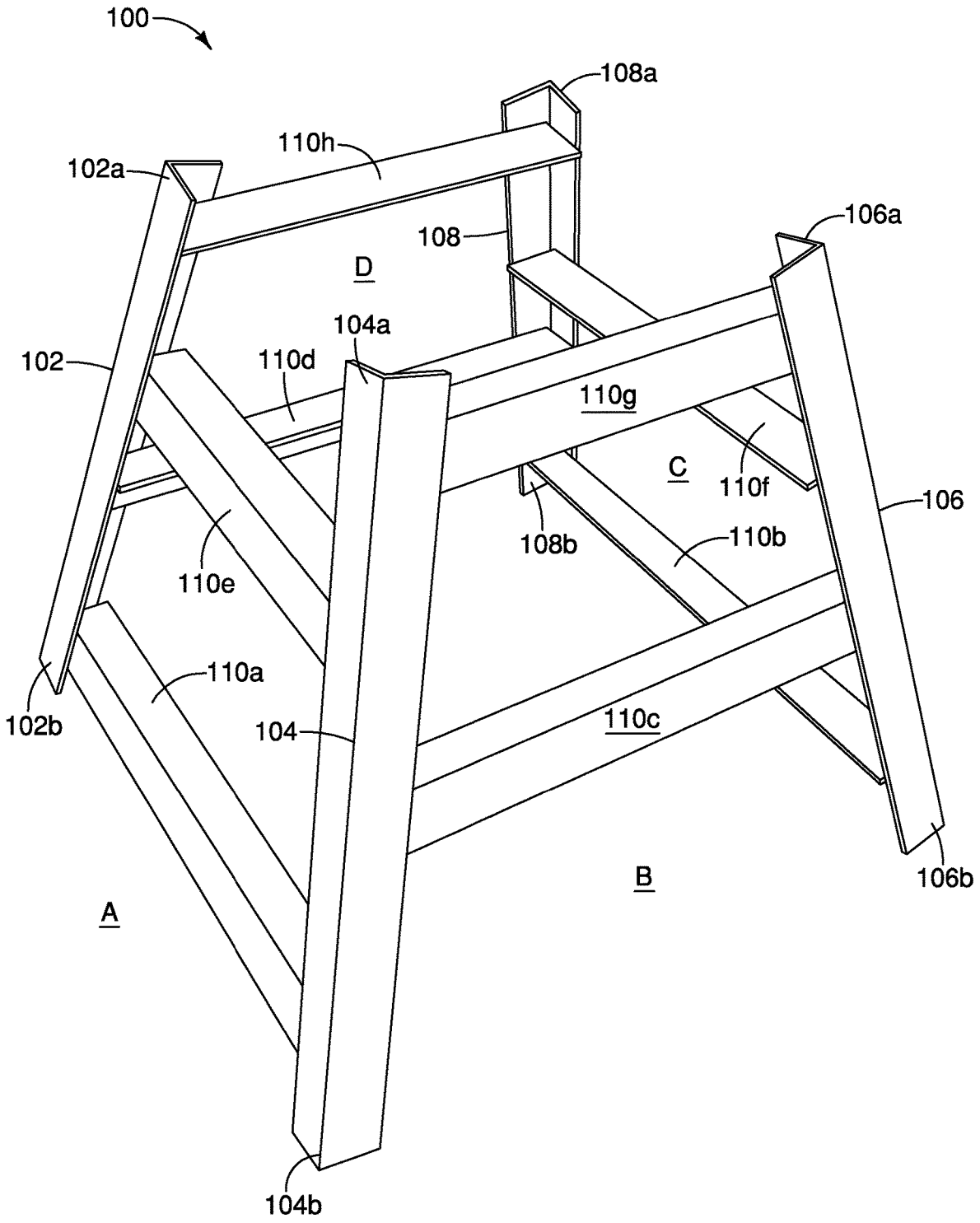
FIG. 1 is a side isometric view of an illustrative embodiment of the disclosed technology.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawings and description are to be regarded as illustrative in nature and not as restrictive.

DETAILED DESCRIPTION OF THE EMBODIMENTS

The disclosed technology generally described hereinafter provides for an apparatus and method for building a sustainable fire. The apparatus and method provide for a unique stacking structure that can be used to build or assemble a sustainable fire.

The apparatus and method described herein produces an efficient burning, sustainable fire that can radiate heat at multiple heights or tiers/levels, which cannot be accomplished with other traditional fire building methods. In terms of the present disclosure, the terms "efficient," "efficient burning," and/or "more efficient" should be understood to mean a fire that requires less tending (i.e. stoking of coals, and/or the continual addition of fuel/firewood to the fire), even under extreme weather conditions. As used herein, the term "sustainable" is used to refer to a fire that (1) tends to burn hotter (due to the multiple tiered structure) and for longer periods of time, as compared to those produced by other traditional fire building methods, (2) can withstand extreme weather, such as, but not limited to, high winds and torrential downpours, (3) provides a safer environment and avoids the threat of collapse, than as compared to those produced by other traditional fire building methods, and (4) eliminates "fire failure", which includes any situation that may lead to the fire being effectively extinguished.

With reference to FIG. 1, the disclosed technology provides for an apparatus for building a sustainable fire. The apparatus as described herein is portable, can be used on any generally flat or planar surface, and can be used in conjunction with a fire pit, barbeque grill, or the like. The apparatus comprises a frame 100. The frame 100 is used to assemble a specific stacking arrangement for building a sustainable fire. In some embodiments, a grate or other generally planar cooking surface can be placed on top of the apparatus 100 to provide a cook-top or means for supporting cooking utensils for cooking or boiling water.

Figure 3:
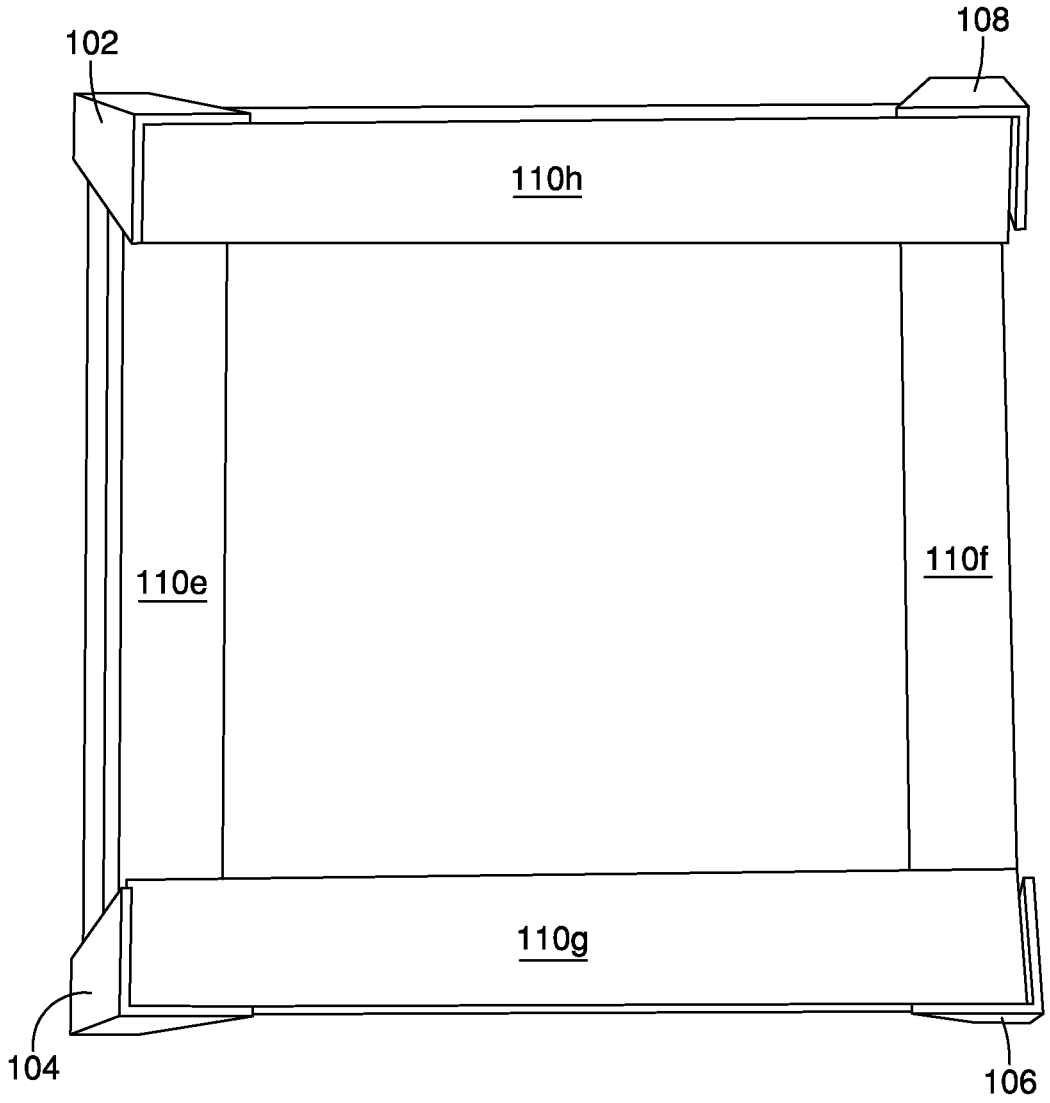
FIG. 3 is a top view of an illustrative embodiment of the disclosed technology.

In some embodiments, the frame 100 is shaped as a generally pyramidal frustum. In some embodiments, as shown in FIG. 3, the frame 100 is shaped as a square frustum. In some embodiments, the frame 100 is a steel frame. In other embodiments, the frame is an iron frame. It should be understood by a person of skill in the art that the frame can be made of any material capable of withstanding high temperatures without melting or disintegrating when subjected to a fire or other burning technique.

As shown in FIG. 1, the frame 100 comprises four substantially vertical members (102, 104, 106, 108). Each vertical member (102, 104, 106, 108) comprises a top end (102*a*, 104*a*, 106*a*, 108*a*) and a bottom end (102*b*, 104*b*, 106*b*, 108*b*). It should be understood by one skilled in the art that the substantially vertical members (102, 104, 106 and 108) are provided at a slight angle from the horizontal in order to provide the apparatus with its pyramidal frustum shape.

The frame 100 provides four sides (A, B, C, D), wherein side A is located between vertical members 102 and 104; side B is located between vertical members 104 and 106; side C is located between vertical members 106 and 108; and side D is located between vertical members 102 and 108. In some embodiments, the distance between the top ends 102*a* and 104*a*; top ends 104*a* and 106*a*; top ends 106*a* and 108*a*; and top ends 102*a* and 108*a* are equal. In some embodiments, the distance between bottom ends 102*b* and 104*b*; bottom ends 104*b* and 106*b*; bottom ends 106*b* and 108*b*; and bottom ends 102*b* and 108*b* are equal. In some embodiments, each side (A, B, C, D) is of equal surface area (as best seen in FIG. 3). In some embodiments, side A and C are of equal surface area, and sides B and D are of equal surface area.

In some embodiments, each vertical member is at least 10 inches in length. It should be understood that each vertical member can be of any length desired without affecting the scope of the disclosed technology. In some embodiments, each vertical member ranges from about 10 to 50 inches in length, in other embodiments, from about 20 to 40 inches, in other embodiments, from about 25 to 35 inches, and in other embodiments, 12 to 20 inches. In some embodiments, each vertical member is approximately 18 inches in length, and in other embodiments, approximately 20 inches in length. In some embodiments, the vertical members (102, 104, 106, 108) are comprised of right-angle steel bars.

Figure 2A:
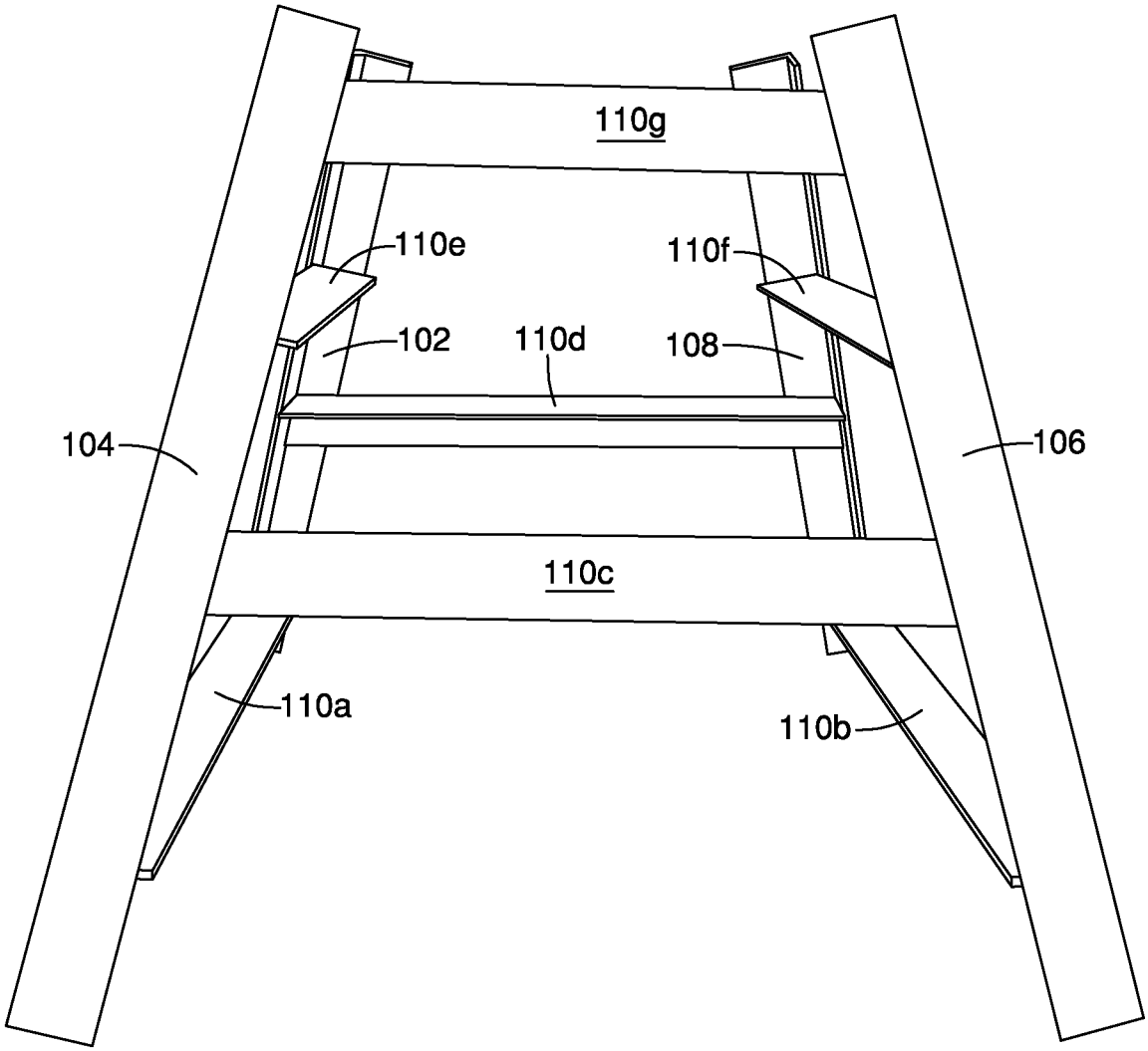
FIGS. 2A-2B are isometric views of an illustrative embodiment of the disclosed technology.
Figure 2B:
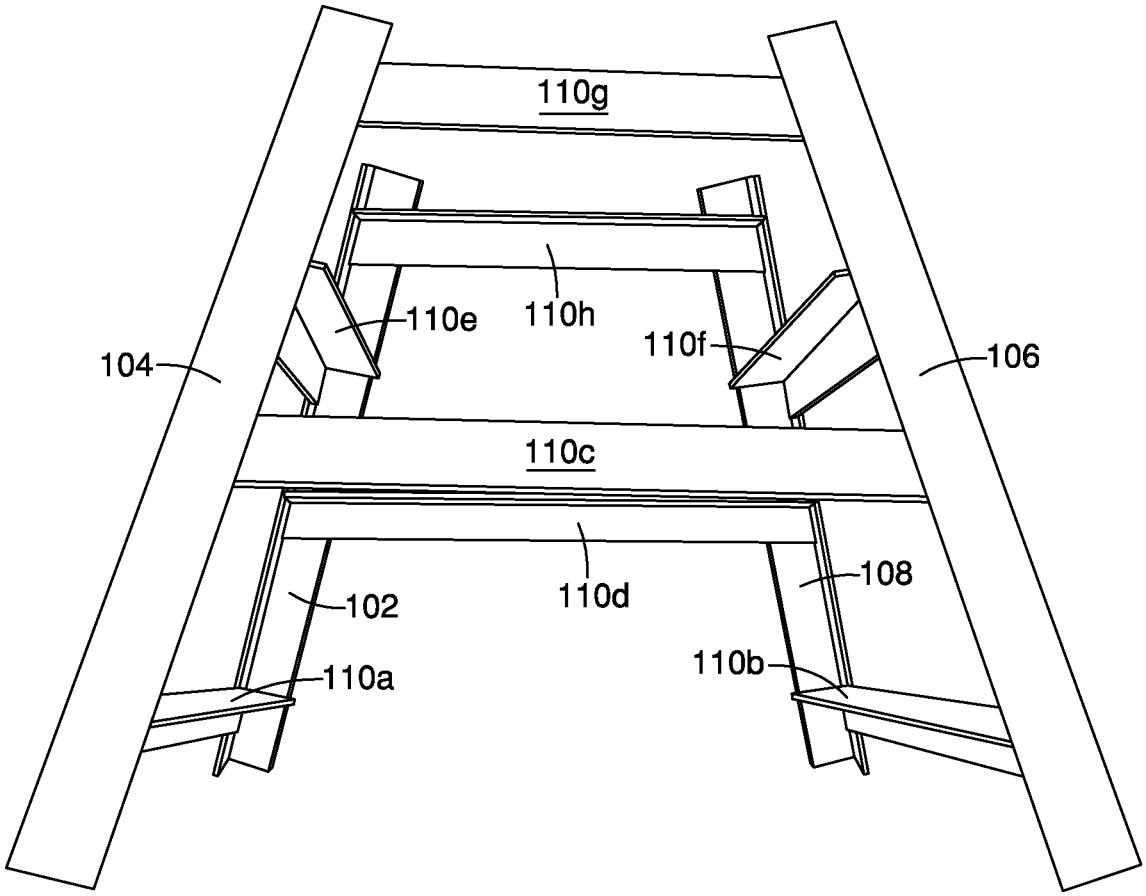

The frame 100 further comprises a plurality of transversely extending, crossbars (110*a-h*) interconnected between the vertical members (102, 104, 106, 108) in a manner best seen in FIGS. 1 and 2A-2B. It should be understood by a person of ordinary skill in the art that the crossbars can be connected to the vertical members by any appropriate means, such as, but not limited to, fasteners, welding, hook-on or hook-in mechanisms, or key lock or key slot assembly or mechanisms.

The crossbars are utilized for the stacking of the firewood, whereas the firewood rests on the crossbars, and provide for a safer surrounding/environment. For example, the crossbars provide adequate structure support to the apparatus which prevents the collapse of the burning fire, or the firewood contained therein, thus ultimately avoiding the threat of collapse of the firewood during or under extreme conditions. The crossbars allow for a user to build a stable, sustainable fire even with less than ideal pieces of firewood (i.e. firewood that is not perfectly straight, not perfectly cut, contains knots, etc.) that would not be suitable for traditional stacking, and would risk the occurrence of collapse. Additionally, the horizontal crossbars (110*a-h*) allow the firewood (i.e. fuel) to fall to the center or core of the pyramidal structure, which further reduces fall out and maintains an efficient, sustainable burn that is contained within the confines of the structure. When an efficient, sustainable burn is created by using the present technology, the need for constant tending by a user is eliminated, as compared with other traditional fire building methods.

As shown in FIG. 1, the crossbars 110*a* and 110*e* are located and transversely extend between vertical members 102 and 104; the crossbars 110*c* and 110*g* are located and transversely extend between vertical members 104 and 106; the crossbars 110*b* and 110*f* are located and transversely extend between vertical members 106 and 108; and the crossbars 110*d* and 110*h* are located and transversely extend between vertical members 102 and 108.

In some embodiments, crossbars 110*a* and 110*b* are of equal length, parallel to each other, and are placed at an equal height from a generally planar surface or ground on which the apparatus is positioned, as shown best in FIGS. 2A and 2B. In some embodiments, crossbars 110*a* and 110*b* are at least 9 in length. In some embodiments, crossbars 110*a* and 110*b* are parallel to crossbars 110*e* and 110*f*, and are generally perpendicular to crossbars 110*c*, 110*d*, 110*g*, and 110*h*.

In some embodiments, crossbars 110*c* and 110*d* are of equal length and parallel to each other. In some embodiments, crossbars 110*c* and 110*d* are placed at an equal height from the generally planar surface or ground on which the apparatus is positioned and are placed at a height that is higher or greater than that of crossbars 110*a* and 110*b*. In some embodiments, crossbars 110*c* and 110*d* are at least 7 in length. In some embodiments, crossbars 110*c* and 110*d* are generally perpendicular to crossbars 110*a*, 110*b*, 110*e*, and 110*f*, and are parallel to crossbars 110*g* and 110*h*.

In some embodiments, crossbars 110*e* and 110*f* are of equal length and are parallel to each other. In some embodiments, crossbars 110*e* and 110*f* are placed at an equal height from the generally planar surface or ground on which the apparatus is positioned and are placed at a height that is higher than crossbars 110*a*, 110*b*, 110*c* and 110*d*. In some embodiments, crossbars 110*e* and 110*f* are at least 5 in length. In some embodiments, crossbars 110*e* and 110*f* are parallel to crossbars 110*a* and 110*b*, and are generally perpendicular to 110*c*, 110*d*, 110*g*, and 110*h*.

In some embodiments, crossbars 110*g* and 110*h* are of equal length and are parallel to each other. In some embodiments, crossbars 110*g* and 110*h* are placed at an equal height from the generally planar surface or ground on which the apparatus is positioned and are placed at a height that is higher than crossbars 110*a*, 110*b*, 110*c*, 110*d*, 110*e* and 110*f* In some embodiments, crossbars 110*g* and 110*h* are at least 3 in length. In some embodiments, crossbars 110*g* and 110*h* are parallel to crossbars 110*c* and 110*d*, and are generally perpendicular to 110*a*, 110*b*, 110*e*, and 110*f*.

In some embodiments, the crossbars (110*a-h*) are comprised of right-angle steel bars. In some embodiments, the frame 100 comprises at least eight crossbars.

When assembled, the apparatus is generally shaped as a pyramidal frustum, and provides for at least four tiers, or levels. As previously explained, the apparatus of the disclosed technology produces a fire that radiates heat at multiple heights or levels, due to the presence of the multiple-tiered frame. In some embodiments, a first tier is comprised of crossbars 110*a* and 110*b*, a second tier is comprised of crossbars 110*c* and 110*d*, a third tier is comprised of crossbars 110*e* and 110*f*, and a fourth tier is comprised of crossbars 110*g* and 110*h*. In some embodiments, the frame 100 provides for at least two tiers.

Figure 4:
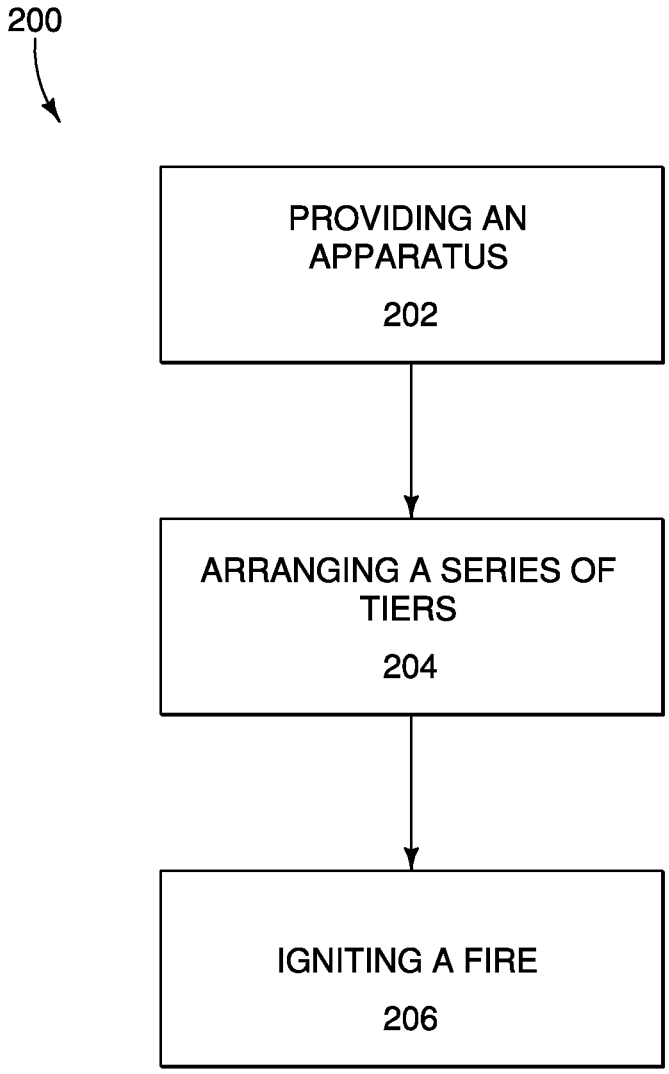
FIG. 4 is a flowchart illustrating an exemplary method in accordance with an illustrative embodiment of the disclosed technology.

In yet another aspect of the disclosed technology, a method for building a sustainable fire 200 is provided. As shown in FIG. 4, the method comprises providing an apparatus (step 202); arranging a series of tiers on or within the apparatus (step 204); and igniting a fire (step 206).

As provided for in step 202, the apparatus comprises a frame. In some embodiments, the frame comprises four substantially vertical members, and a plurality of transversely extending crossbars therebetween. In some embodiments, the frame is generally shaped as a pyramidal frustum or a square frustum. In some embodiments, the apparatus provides for a series of tiers.

As provided for in step 204, arranging a series of tiers comprises assembling, arranging, positioning or loading a plurality of firewood onto each tier provided for by the apparatus. It should be understood that the plurality of firewood may include, but is not limited to, logs, wood, timber, kindling, and/or a combination thereof. The firewood can be of multiple shapes and/or sizes, treated or untreated, and can be comprised of either natural or synthetic material. However, it is preferable that, in some embodiments, the firewood be of the approximate length of the horizontal bars on the tier of which the firewood rests. For example, the firewood placed on crossbars 110*a* and 110*b* to create the first tier, should be at least the length of crossbars 110*a* and 110*b*. In other words, for example, the firewood must be at least the length required to firmly rest on the crossbars 110*a* and 11*b* to create the first tier. This helps eliminate the firewood from falling out of the tier or slipping off of the crossbars.

The specific arrangement of the series of tiers provides additional benefits over other traditional fire building methods. The disclosed technology provides for a sustainable fire that is easily maintained and can withstand extreme weather, such as, but not limited to, torrential downpours, which is attributed to the stable and durable apparatus structure and how the firewood is placed therein. When fully stacked or loaded, the tiers eliminate "fire failure", which includes any situation that may lead to the fire being extinguished. For example, the sustainable fire will continually burn and will be fueled by the firewood arrangement even in torrential downpours. Additionally, the strategically placed firewood or logs in successive tiers, when added, will act as a roof to essentially shelter the fire, and the lower tiers below, from heavy rains or downpour without extinguishing the fire. Another advantage that the series of tiers provides is that once the firewood positioned on a higher tier has been spent or burnt up, a user can add additional firewood to each tier, including the top tier, without the entire fire structure collapsing, being suffocated, or extinguished.

In some embodiments, step 204 comprises (a) arranging a first tier; (b) arranging a second tier; (c) arranging a third tier; and (d) arranging a fourth tier. It should be understood that the series of tiers can be arranged from either top-to-bottom, or bottom-to-top, without departing from the scope of the present technology. For example, in some embodiments, the first tier is the lower-most or lowest tier, and in other embodiments, the first tier is the upper-most or highest tier; and in other embodiments, the fourth tier is the lower-most or lowest-tier, and in other embodiments, the fourth tier is the upper-most or highest tier.

Figure 5:
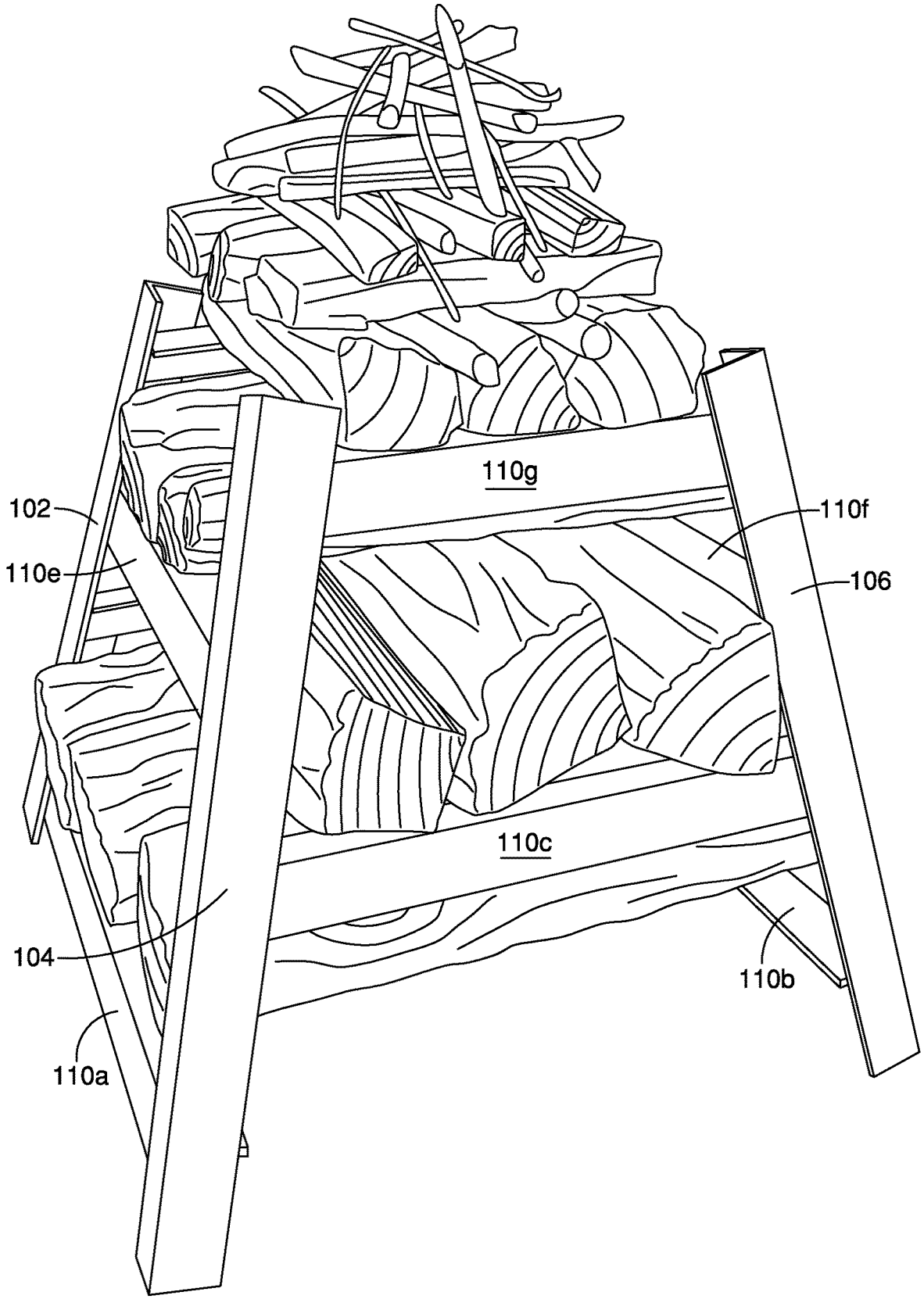
FIG. 5 is a side isometric view of an illustrative embodiment of the disclosed technology.

In some embodiments, and as shown best in FIG. 5, (i) the second tier comprises a plurality of firewood that is positioned transverse to the plurality of firewood positioned on the first tier; (ii) the third tier comprises a plurality of firewood that is positioned transverse to the second tier and parallel to the first tier; and (iii) the fourth tier comprises a plurality of firewood that is positioned transverse to the third tier and the first tiers, and parallel to the second tier.

In some embodiments, as in step 204, the firewood can be arranged or stacked from largest to smallest, starting with the lower-most tier. In some embodiments, for example, the largest firewood is placed or rests on the lower-most tier, medium-sized firewood (at least smaller than that positioned on the first tier) is placed or rests on the second tier, smaller-sized firewood (at least smaller than that positioned on the second tier) is placed or rests on the third tier, and firewood comprising large sticks, kindling, or tinder is placed or rests on the fourth tier. In some embodiments, smaller sticks, kindling, or tinder can be placed adjacent to the firewood positioned within each tier. In such an arrangement, the firewood will be arranged more tightly (i.e. less air space between each tier) and results in a slower (i.e. longer) burning fire. For example, the specific arrangement allows for a sustainable fire that can withstand collapse due to high winds and downpours, yet continues to burn even under such extreme conditions.

Stacking, arranging or loading the firewood in the manner described herein provides for additional benefits as compared to other traditional fire building methods. When building a fire according to the present technology, a user can produce a fire that tends to burn hotter and for longer periods of time, which is due to the placement of the firewood on the tiers and the multiple-tiered structure. The apparatus and method provide for consistent air flow from the bottom of the apparatus due to the lowest tier not being placed directly adjacent to the ground or surface on which the apparatus rests, thus resulting in a more sustainable fire.

Figure 6:
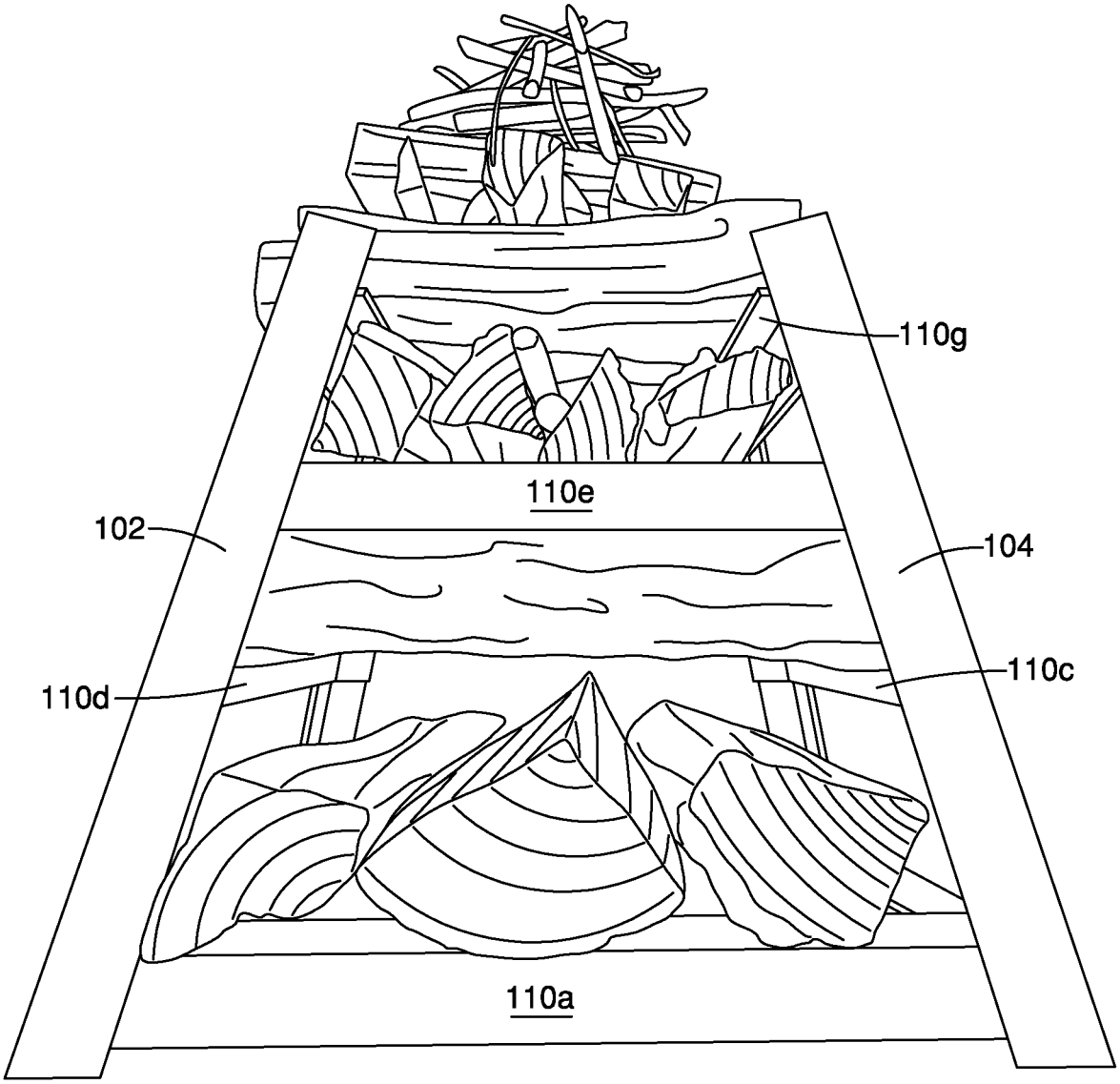
FIG. 6 is a side isometric view of an illustrative embodiment of the disclosed technology.

In some embodiments, as described in step 204, the series of tiers, when loaded, physically touch. In other embodiments, the series of tiers, when loaded, do not physically touch. For example, as can be best seen in FIG. 6, when the plurality of firewood is fully loaded or assembled on or within the apparatus, the plurality of firewood positioned within each tier is not stacked directly on-top of each other, (i.e. each tier does not physically touch). By providing adequate spacing between each tier (i.e. each tier rests on the crossbars and does not rest directly on-top of each other), more air flow is provided to the fire itself, and provides the benefit of a faster burning fire to a user.

The method further comprises igniting a fire (step 206). In some embodiments, igniting a fire comprises starting, lighting or igniting the plurality of firewood that is located or positioned on a tier. In some embodiments, igniting the fire begins at or on the fourth tier. In some embodiments, the fourth tier is the upper-most tier or highest tier located on the frame. In some embodiments, the plurality of firewood that is located or positioned on the fourth tier is provided in an upside-down fire stacking arrangement.

By igniting the fire from the upper-most or top tier of the frame, a "top-down" burn or "self-feeding" sustainable fire results. When the fire is ignited from the top (versus traditional methods which light or ignite a fire from the base), the burning firewood material will fall-in onto itself and burn the tier positioned below it. This characteristic is vital to a user who requires a sustainable fire, which can be maintained for longer periods of time with limited firewood material (and without continual tending), and that can withstand downpours and extreme conditions where a fire is required for survival.

In yet another aspect of the disclosed technology, an apparatus for building a sustainable fire is provided. The apparatus comprises a frame, wherein the frame is generally shaped as a square frustum, the frame having: (a) four substantially vertical members, each vertical member being at least 18 inches in length, wherein each vertical member is a right-angle steel bar; and (b) eight transversely extending crossbars, wherein each crossbar is a right-angle steel bar, wherein the frame provides for at least four tiers or stacked levels.

In some embodiments, the apparatus is foldable or collapsible. In some embodiments, the crossbars may comprise hook-on or hook-in mechanisms (not shown in figures), or key lock or key slot assembly or mechanisms, which can attach to the vertical members. In such embodiments, the apparatus can be completely disassembled when not in use in order to be easily carried or transported.

While embodiments of the disclosed technology have been described, it should be understood that the present disclosure is not so limited, and modifications may be made without departing from the disclosed technology. The scope of the disclosed technology is defined by the appended claims, and all devices, processes, and methods that come within the meaning of the claims, either literally or by equivalence, are intended to be embraced therein.

The invention claimed is:

1. A method for building a sustainable fire, the method comprising:

providing an apparatus;

arranging a series of tiers on the apparatus, wherein the series of tiers comprises at least four tiers that do not physically touch comprising (a) arranging a first tier;

(b) arranging a second tier;

(c) arranging a third tier; and (d) arranging a fourth tier;

wherein (i) the second tier comprises a plurality of firewood that is positioned transverse to a plurality of firewood positioned on the first tier; (ii) the third tier comprises a plurality of firewood that is positioned transverse to the second tier and parallel to the first tier; and (iii) the fourth tier comprises a plurality of firewood that is positioned transverse to the third tier and the first tiers, and parallel to the second tier; and igniting a fire.

2. The method as recited in claim 1, wherein the apparatus comprises a frame.

3. The method as recited in claim 2, wherein the frame comprises four substantially upright members, and a plurality of transversely extending crossbars therebetween.

4. The method as recited in claim 2, wherein the frame is generally shaped as a pyramidal frustum.

5. The method as recited in claim 1, wherein the step of arranging a series of tiers on the apparatus includes loading a plurality of firewood onto the series of tiers.

6. The method as recited in claim 1, wherein the step of igniting a fire comprises starting, lighting, or igniting the plurality of firewood that is located or positioned on the fourth tier.

7. The method as recited in claim 6, wherein the fourth tier is located at the upper-most portion of the apparatus.

8. The method as recited in claim 6, wherein the plurality of firewood that is located or positioned on the fourth tier is provided in an upside-down fire stacking arrangement.

9. The method as recited in claim 2, wherein the frame comprises a steel frame.

10. The method as recited in claim 2, wherein the frame comprises at least eight crossbars.

11. The method as recited in claim 2, wherein the frame is foldable or collapsible.

12. The method as recited in claim 3, wherein the upright members are comprised of right-angle steel bars.

13. The method as recited in claim 3, wherein the upright members are at least 10 inches in length.

14. The method as recited in claim 3, wherein the crossbars are comprised of right-angle steel bars.

* * * * *